United States Patent [19]

Sampson et al.

[11] Patent Number: 4,696,244

[45] Date of Patent: Sep. 29, 1987

[54] THREAD CHAINING DETECTOR

[75] Inventors: Mark E. Sampson, Cottage Grove, Minn.; Marvin E. Rosen, New Richmond, Wis.

[73] Assignee: Doboy Packaging Machinery, Inc., New Richmond, Wis.

[21] Appl. No.: 944,875

[22] Filed: Dec. 22, 1986

[51] Int. Cl.[4] ..... D05B 13/02; D05B 51/00

[52] U.S. Cl. ..... 112/262.1; 112/11; 112/130; 112/272; 112/278; 112/273

[58] Field of Search ..... 112/11, 10, 121.26, 112/121.27, 273, 272, 278, 262.1, 262.3, 265.1, 130; 53/139

[56] References Cited

U.S. PATENT DOCUMENTS

| | | | |
|---|---|---|---|
| 3,039,409 | 6/1962 | Cordle . | |
| 3,046,919 | 7/1962 | Fox . | |
| 3,082,718 | 3/1963 | Scharmer, Jr. . | |
| 3,091,198 | 5/1963 | Lanz . | |
| 3,527,180 | 9/1970 | Cerioni . | |
| 3,654,882 | 4/1972 | Kamena . | |
| 3,747,543 | 7/1973 | Fishbein et al. . | |
| 3,782,069 | 1/1974 | Fischbein et al. . | |
| 3,847,099 | 11/1974 | Braun | 112/121.26 X |
| 3,980,032 | 9/1976 | Kleinschmidt et al. | 112/121.26 X |
| 4,186,672 | 2/1980 | Burton | 112/273 |
| 4,195,292 | 3/1980 | Puhich | 112/278 X |
| 4,196,685 | 4/1980 | Tamura | 112/278 X |
| 4,215,641 | 8/1980 | Dobrjanskyj et al. | 112/278 |
| 4,254,724 | 3/1981 | Conrads . | |
| 4,398,348 | 8/1983 | Bergvall et al. . | |
| 4,408,554 | 10/1983 | Takiguchi et al. | 112/278 X |
| 4,489,436 | 12/1984 | Yoshimura et al. | 112/278 X |
| 4,590,874 | 5/1986 | Baclagis | 112/121.26 |

*Primary Examiner*—H. Hampton Hunter

*Attorney, Agent, or Firm*—Orrin M. Haugen; Thomas J. Nikolai; Frederick W. Niebuhr

[57] ABSTRACT

A bag closing container device applies a strip of closure tape to a container, and sews stitches through the tape and container walls, as the container is moved past a closure station. A first sensor, located near an encoder disc driven by the container transport motor, generates a signal proportional to the container transport speed. An idler roller frictionally engaged with the closure tape carries an indicator wheel, which generates in a second sensor a signal proportional to the tape speed. The thread used in stitching the containers is wrapped around a detector wheel on its way to the closure station, and is frictionally engaged with the wheel. Wheel rotation generates in a third sensor a signal proportional to thread speed. The device includes a microprocessor which receives the signals as inputs, continually compares container transport speed and thread speed, and generates a thread fault indication if the thread and container speeds deviate from a preselected ratio. Similarly, the microprocessor compares tape speed and container speed, and generates a tape fault signal should the tape speed and container speed deviate from their prescribed ratio.

24 Claims, 12 Drawing Figures

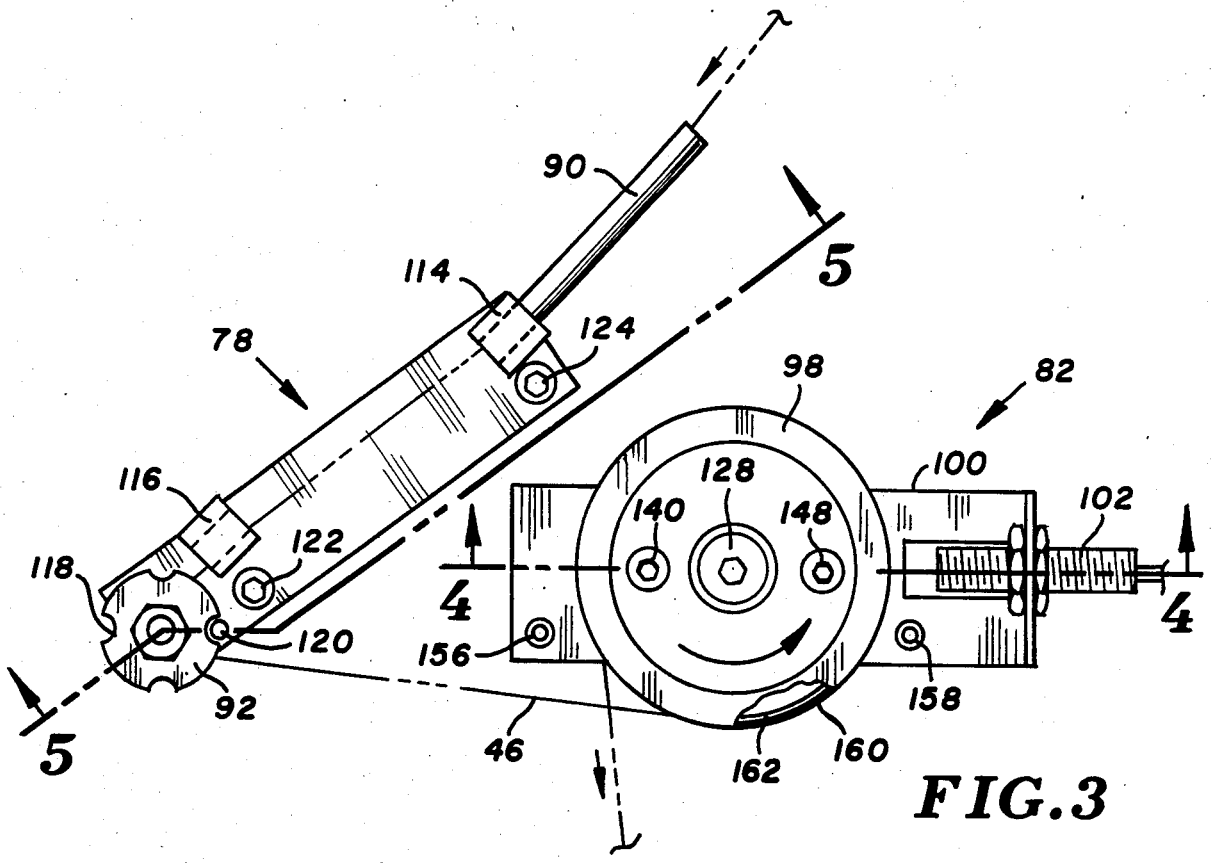
FIG. 3
FIG. 4
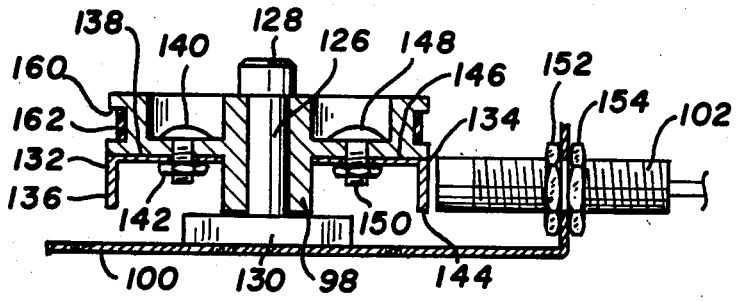
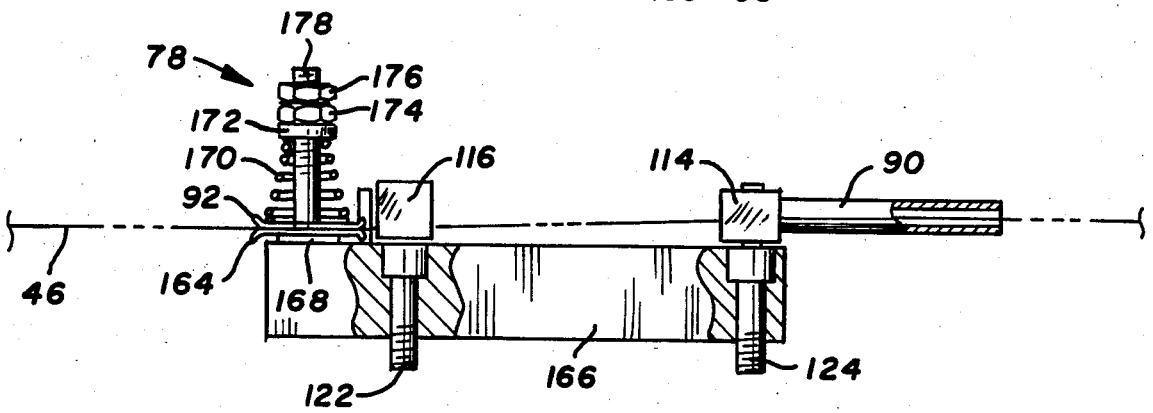
FIG. 5

THREAD CHAINING DETECTOR

BACKGROUND OF THE INVENTION

This invention relates to devices for stitching closed the open ends of pliable containers such as thick walled or multi-layered paper bags that contain water softener salt, pet food and other dry products. More particularly, this invention concerns an apparatus and method for monitoring the feed velocity of thread to a stitching station to ensure that proper stitching is occurring. In applications utilizing closure tape to secure the open ends, this invention further concerns measuring the closure tape supply velocity to monitor its application to the containers.

Devices for stitching closed the open upper ends of upright bags are known, examples of such devices being found in U.S. Pat. No. 3,460,494 (Denker), and U.S. Pat. No. 3,782,069 (Fischbein). Such devices ordinarily employ a conveyor, carrying chains or other means to transport filled bags past a sewing head along the path traversed by the bags. At the sewing head, a needle forms stitches through the top portion of each bag. Many of these devices employ chain stitching, in which a sewing needle on one side of the bags operates on a first strand of thread, and a looper on the opposite side of the bags operates on a second strand of thread, in cooperation with the needle, to form a thread chain including thread from both strands. This process, called thread chaining with single or double thread, is described for example in the Denker patent.

A long recognized need in connection with such devices is thread monitoring, in order to ensure that proper stitching is taking place. One known approach is to employ a thread break detector, which responds to a total absence of thread movement to signal a fault or terminate operation of a sewing device. A significant problem with this approach, however, arises due to stitching faults caused by problems other than thread breakage.

More specifically, there can be excessive, or inadequate, tension in the needle thread caused by soiled or worn tensioner discs, or slippage of the thread from between the tensioner discs. A damaged needle can cause improper stitching. These faults, while altering thread supply speed, do not necessarily break the thread and thus can go undetected. The general concept of controlling stitching with respect to the feed-through speed of an item being stitched is known. For example, U.S. Pat. No. 3,654,882 (Kamena) discloses a control system that enables selection of the desired number of stitches per inch. An automatic embroidery device is shown in U.S. Pat. No. 4,254,724 (Conrads), in which an absolute position shaft encoder 1, driven by the sewing machine drive shaft, generates signals used to properly time various stitching actions. Also, to detect movement of cloth being sewn, U.S. Pat. No. 4,398,348 (Bergvall) discloses a toothed wheel 14 which engages the cloth and rotates as the cloth moves. A photoelectric detector senses wheel rotation.

While satisfactory in various specific applications, the above techniques do not adequately address the need for sensing the length of thread or other closure material consumed, in comparison to the linear travel of a container being closed, in order to ensure that proper closure is occurring.

Therefore, it is an object of the present invention to provide an apparatus and method for comparing the length of thread or other closure material used by a closure device in relation to the amount of linear travel of the containers being closed.

Another object is to provide an apparatus for monitoring thread consumption which is not time-dependent, and therefore automatically adjusts to changes in container transport speed.

Yet another object of the invention is to provide an apparatus for monitoring thread supply speed, in relation to container transport speed, without disturbing or interferring with the operation of the sewing device.

SUMMARY OF THE INVENTION

To achieve these and other objects, there is provided an apparatus for closing the open ends of pliant containers. The apparatus includes a frame, a closing station mounted with respect to the frame, and a container transport means mounted to the frame for moving a plurality of pliant containers in succession past the closing station. A first supply means is mounted to the frame for continuously feeding a first closure material to the closing station, for joinder of the first closure material with the containers at their open ends, thus to close the containers as they are moved past the closure station. A first sensing means is mounted with respect to the frame and generates a first signal having a first signal level that varies with the velocity of the container transport means. A second sensing means, also mounted with respect to the frame, generates a second signal with a second signal level that varies with the speed at which the first closure material is moved from the supply means toward the closing station. A comparator means receives the first and second signals as inputs, compares the first and second levels, and provides a first fault indication whenever the ratio of the first and second levels deviates from a first predetermined normal range.

The first closure material can be a continuous strip of closure tape, with the first supply means then being a reel for the closure tape. Alternatively, the first closure material can be a thread, in which case stitching occurs at the closing station. Moreover, the closure tape and thread may be simultaneously supplied to the closure station. In this event, the thread is directed to a closure station location downstream of the location to which tape is supplied, so that stitching occurs through the closure tape as well as the container side walls.

Another aspect of the present invention is an apparatus for detecting the speed of thread as it is fed from a supply means to a sewing station. The apparatus includes a frame, a thread supply means mounted to the frame, and a sewing station mounted to the frame in spaced apart relation to the thread supply means. An idler pulley is mounted rotatably with respect to the frame along the path of thread, and is frictionally engaged with respect to the thread. The idler pulley carries a first indicator element, and a sensing means is mounted with respect to the frame for registering a pulse each time the first indicator element passes near the sensing means, thus to generate a signal which varies with the rotational velocity of the idler pulley. A comparator means compares the level of the signal with a reference signal level, and a fault indicator means indicates a sensed deviation of the velocity signal level from a predetermined relation to the reference signal level.

Yet another aspect of the invention is a process for effecting closure of the open ends of pliant containers, and for detecting a deviation from a desired amount of closure material employed in such closure. The process includes the steps of:

(1) Transporting a pliant container past a stitching station using a container transport means;

(2) Generating a first signal, the level of which is directly related to the transport speed of the containers;

(3) Supplying thread to the stitching station;

(4) Generating a second signal, the frequency of which is directly related to the speed at which thread is supplied to the stitching station;

(5) Comparing the levels of the first and second signals; and (6) Generating a thread fault indication responsive to a sensed deviation in the ratio of the first and second levels from a predetermined ratio.

Preferably, the step of transporting compliant containers includes frictionally engaging portions of the containers with moving endless carrier chains. The step of generating a first signal then includes sensing the velocity of the carrier chains.

The apparatus and method of the present invention enable direct measurement of thread or closure tape speed, for comparison to carrier transport speed or another desired reference, with virtually no interference with the closure machinery, a result which permits convenient retrofitting of present machinery. As thread or tape velocity can be associated with container transport velocity, there is no need to make timing or other adjustments should the container transport speed and closure speed be altered. Furthermore, the presently disclosed apparatus and method provide a reliable means for detecting stitching faults occurring in the absence of thread breakage.

IN THE DRAWINGS

The foregoing and other features and advantages become readily apparent upon consideration of the following detailed description, and the drawings, in which:

FIG. 3 is an enlarged partial view of FIG. 2;

FIG. 4 is a sectional view taken along the line 4—4 in FIG. 3;

FIG. 5 is a sectional view taken along the line 5—5 in FIG. 3;

DETAILED DESCRIPTION OF THE PREFERRED EMBODIMENT

Figure 1:
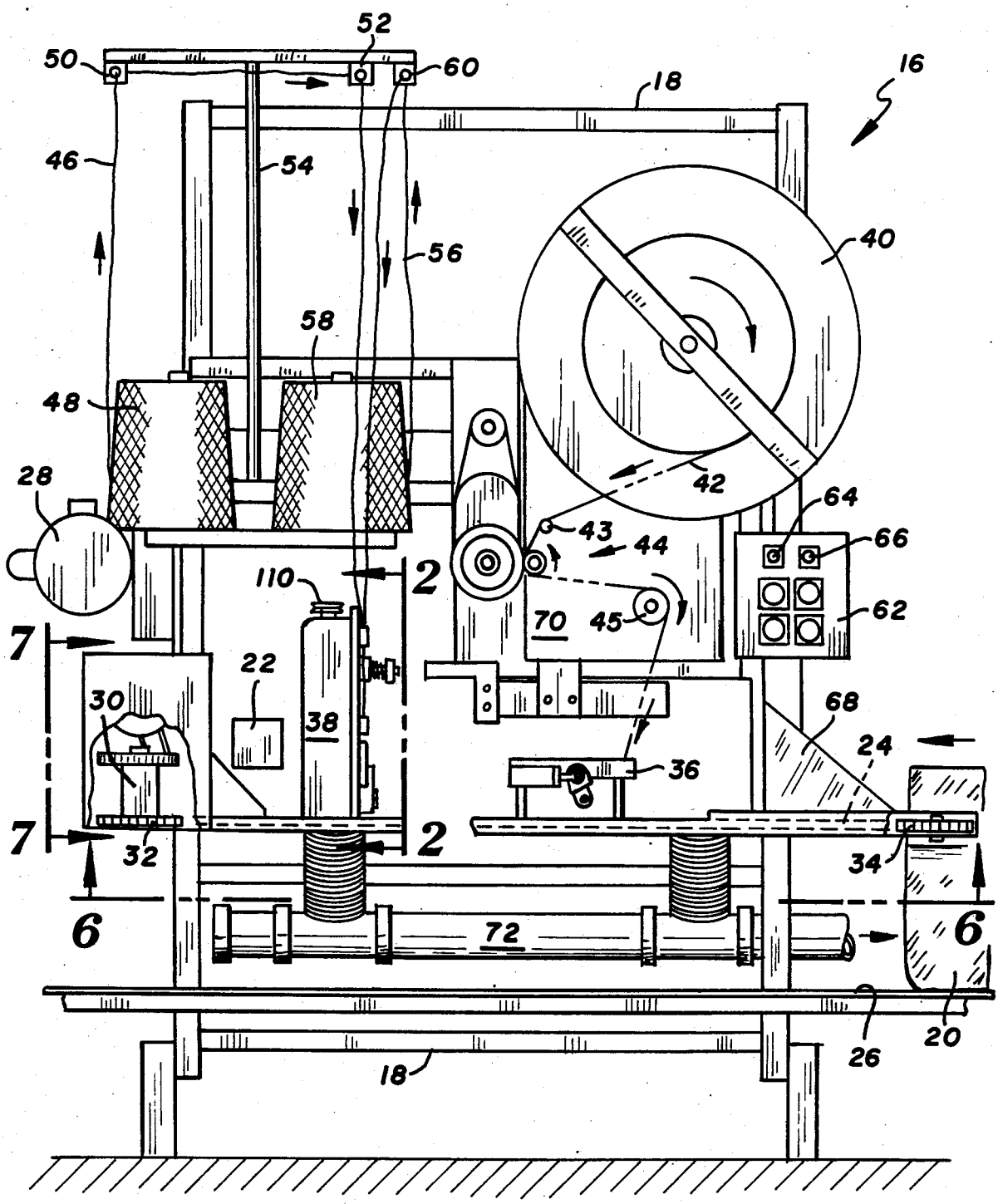
FIG. 1 is a front elevation of a bag closure device constructed in accordance with the present invention.

Turning now to the drawings, there is shown in FIG. 1 a bag closure device 16 for fastening shut the upper, open ends of multi-layered paper bags. Mounted to a frame 18 of the device are various components which cooperate to accomplish bag closure. A bag transport assembly moves containers, such as a bag 20, through device 16 and past a closure station, where closure tape from a tape supply reel is secured over the bag open ends, after which thread from a thread supply assembly is stitched through the open ends and through the tape. A cutting and trimming assembly separates the tape and thread at locations intermediate successive bags, and further trims loose ends of tape and thread from each bag for an improved appearance. The cutting and trimming assembly, indicated at 22 but not further described, is not directly pertinent to the present invention.

The bag transport assembly includes a pair of carrier chains indicated at 24, which grip each bag 20 near its open end and carry it frictionally along the interface between opposed chains. A conveyor 26 also can be provided, particularly in the event that bags 20 are filled with an unusually dense or heavy product. However, in the majority of applications, the gripping action of the opposed chains is sufficient to support bags 20 as well as transport them. A transport motor 28 is drivably linked to a chain drive in a housing 30 as is later explained, to rotate a first chain drive sprocket 32 and an opposed second chain drive sprocket not shown in FIG. 1, each drive sprocket supporting and driving its associated carrier chain. At the upstream end of the carrier chains are first and second idler sprockets, the first idler sprocket being shown at 34.

Figure 2:
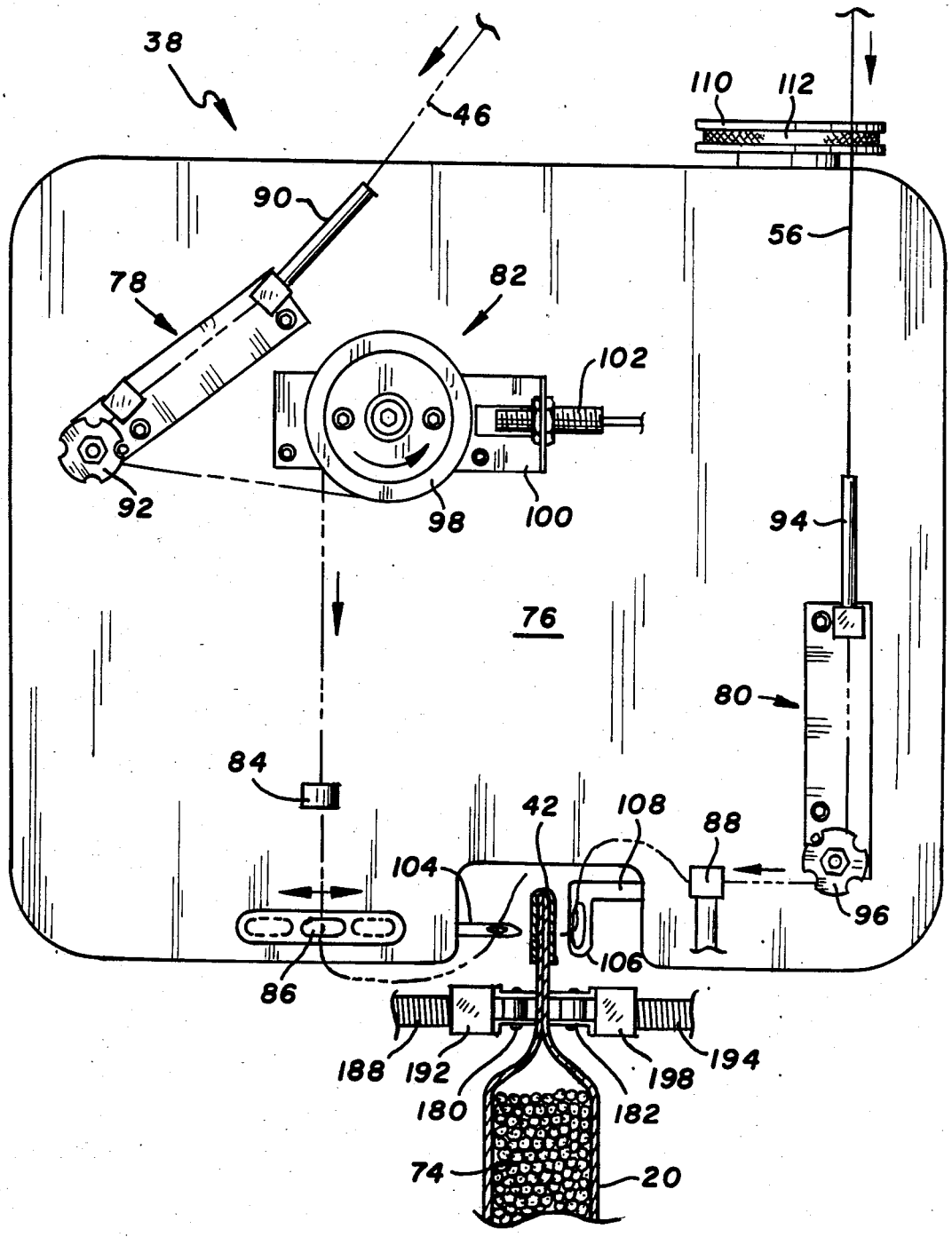
FIG. 2 is an enlarged partial side view of the device in FIG. 1, taken along the line 2—2.

The closure station lies along the bag path of travel, and includes a tape handling device 36 and a sewing head 38 downstream of the tape handling device. From a tape supply reel 40, closure tape 42 is guided through a tape speed sensor 44, and over idler rollers 43 and 45, on its way to device 36. At the tape handling device, closure tape 42 is bent over the upper ends of each bag 20 and pressed firmly against these ends in an inverted "U" configuration as shown in FIG. 2. The manner in which this is achieved is known and not further discussed.

Two separate strands of thread are supplied to sewing head 38. Needle thread 46 is supplied to the sewing head from a needle thread spool 48, and is guided along the way by first and second brackets 50 and 52 of a thread support standard 54 mounted to the frame. Also supplied to the sewing head is a looper thread 56, from a looper thread spool 58. A third bracket 60 on standard 54 guides the looper thread. For single thread stitching, no looper thread is required.

Other components of bag closure device 16 include a control panel 62 which houses first and second fault indicator lamps 64 and 66, a transparent plastic cover 68 with a slot formed in its upwardly facing surface to accommodate bag travel, a support panel 70 for tape reel 40, and an air exhaust system 72 for evacuation of pressurized air employed in device 16 for assisting in tape closure and maintaining clean surroundings.

FIG. 2 illustrates sewing head 38, with a bag 20 filled with a product 74 such as water softener salt, shown in section as it is fastened shut by stitches formed from needle thread 46 and looper thread 56. Attached to a cover plate 76 of the sewing head are first and second thread tensioning devices 78 and 80, a thread speed sensing device 82, and guides 84, 86 and 88.

Thread tensioning device 78 includes a tubular guide 90 for receiving needle thread 46 from bracket 52, and a pair of tension setting discs, the outer one of which is shown at 92. In similar fashion, thread tensioning device 80 includes a tubular guide 94 and a pair of tension setting discs, the outer of such discs indicated at 96.

Thread speed sensing device 82 includes a detector wheel 98 rotatably mounted with respect to cover plate 76. Needle thread 46 is wrapped substantially around the entire perimeter of detector wheel 98 to frictionally engage the wheel. Consequently, rotational speed of the detector wheel is directly proportional to linear speed of the needle thread. A thread sensor bracket 100 supports wheel 98 and a thread sensor 102.

A sewing needle 104 draws needle thread 46 through tensioning device 78, around detector wheel 98 and through guides 84 and 86 and ultimately to the bag for stitching. To supply the remainder of the stitching, a looper 106 supported by a looper arm 108 draws looper thread 56 from standard 54, through tensioning device 80 and guide 88. The manner in which needle 104 and looper 106 cooperate to form stitches through closure tape 42 and the upper edges of bag 20 is described in U.S. Pat. No. 3,460,494 (Denker).

Supported in spaced relation to the top of sewing head 38 is a sewing head pulley 110, which ordinarily is covered by a shield which is not shown. Sewing head pulley preferably is drivably associated with transport motor 28, for example through a V-belt 112, but also could have its own motor. Through additional belts and pulleys contained in sewing head 38 and not illustrated, needle 104 and looper 106 are simultaneously driven as sewing head pulley 110 rotates. This ensures synchronization of the needle and looper, regardless of variations in their speed.

When both needle 104 and looper 106 are utilized as illustrated in FIG. 2, a "double lock" stitch is created, which is particularly well adapted for fastening bags slated for heavy-duty use. An alternative is the "single chain" stitch, which uses only the needle thread and does not employ a looper. For single chain stitching, one thread speed sensing device 82 clearly is sufficient. Futher, it has been found in connection with double lock stitching that no added sensing device need be employed with looper thread 56. This is because any breakage in the looper thread results in needle thread to be drawn by needle 104 at a reduced rate, which is then sensed by sensing device 82.

As seen in FIG. 3, first thread tensioning device 78 includes a holder 114 supporting tubular guide 90, and a rectangular guide 116 intermediate the tubular guide and tension discs. Formed in the tensioning discs are cut-outs 118, each of which may be positioned adjacent a pin 120, thus to permit incremental adjustment of the position of the tension discs. Allan head fasteners 122 and 124 secure the thread tensioner to cover plate 76.

As seen from FIGS. 3 and 4, detector wheel 98 is rotatably mounted to bracket 100 by a wheel shaft 126 with an enlarged head 128 and a base portion 130 for securing the shaft to the bracket. The detector wheel carries an indicator means including first and second proximity flags 132 and 134 opposite one another and spaced apart from each other 180° of wheel rotation. Flag 132 includes marker portion 136 parallel to the wheel shaft axis, and a support portion 138 normal to the marker portion and secured to detector wheel 98 by a cap screw 140 and nut 142. Likewise, flag 134 includes marker and support portions 144 and 146, respectively and is secured to the wheel by cap screw and nut 148 and 150.

Thread sensor 102 is a proximity switch secured to bracket 100 by nuts 152 and 154, in positionally adjustable fashion. Sensor 102 registers a pulse each time wheel rotation carries one of the proximity flags, more particularly marker portions 136 and 144, past the left end of the sensor as viewed in FIGS. 3 and 4. Fasteners at 156 and 158 secure the bracket to cover plate 76.

An annular recess 160 is formed in detector wheel 98 at its perimeter, and an endless elastic band 162 surrounds the wheel and is contained in the recess. Elastic band 162 thus defines the perimeter of detector wheel 98, and provides a surface with a high friction coefficient to prevent needle thread 46 from slipping relative to the wheel.

FIG. 5 shows first thread tensioning device 78 in greater detail. Outer tension disc 92 and an inner tension disc 164 are mounted in facing relation, and supported apart from a tensioner body 166 by an inner disc spacer 168. A coil spring 170 is held in compression between outer disc 92 and an outer disc spacer 172. Lock nuts 174 and 176, mounted on an externally threaded elongate member 178, can be moved to adjust the compression of coil spring 170. This compression adjustment, together with the incremental adjustment of discs 92 and 164 earlier described, permits a precise adjustment of thread tension.

Figure 6:
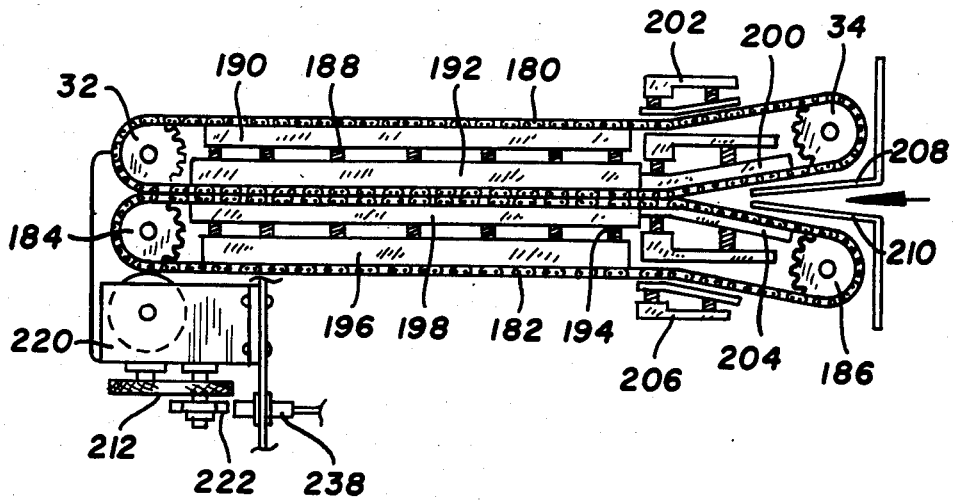
FIG. 6 is a sectional view taken along the line 6—6 in FIG. 1.

The view of FIG. 6 is taken looking upwardly into device 16, and reveals further details of the bag transport assembly. The pair of carrier chains includes a first steel carrier chain 180 entrained about first chain drive sprocket 32 and first idler sprocket 34. A second steel carrier chain 182 is supported by a second chain drive sprocket 184 and a second idler sprocket 186, in opposition to first carrier chain 180.

A series of first chain biasing springs 188, maintained in compression between a first backing plate 190 and a first pressure plate 192, cause pressure plate 192 to urge a portion of first carrier chain 180 inward (downward as viewed in FIG. 6). Likewise, a series of second chain biasing springs 194, compressed between a second backing plate 196 and a second pressure plate 198, outwardly bias the second carrier chain. Consequently the carrier chains along portions of their lengths are contiguous in the absence of any bag 20, and positively grip and support a bag 20 positioned between them.

By virtue of first inside and outside chain guides 200 and 202, and second inside and outside chain guides 204 and 206, first and second carrier chains 180 and 182 are deflected at their upstream ends to form a relatively wide capture area for incoming bags 20. To further enhance gripping action, opposed slanted walls 208 and 210, integral with frame 18, form an entrance throat for the bags.

Figure 7:
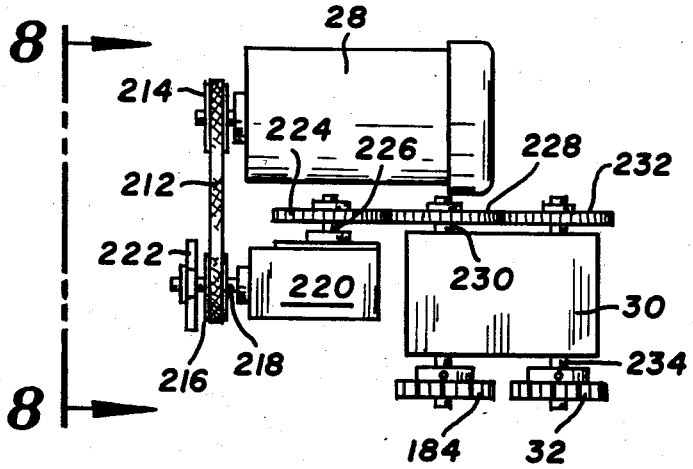
FIG. 7 is a partial end view of FIG. 1 taken along the line 7—7.

The bag transport assembly is further understood from FIG. 7, showing transport motor 28 and the assembly for drivably engaging the transport motor with first and second chain drive sprockets 32 and 184. A drive belt 212 engages a motor pulley 214, and a reducer pulley 216 mounted on a horizontal shaft 218 of a gear reducer 220. Also mounted on horizontal shaft 218 is an encoder disc 222. Joining gear reducer 220 and the carrier chains is a drive gear train including a first gear 224 mounted on a vertical gear reducer shaft 226, a second gear 228 engaged with the first gea and carried on a drive shaft 230, and a third gear 232 engaged with second gear 228 and carried on a drive shaft 234. Shafts 230 and 234 carry second chain drive sprocket 184 and first sprsocket 32, respectively, and are supported rotatably in housing 30.

Figure 8:
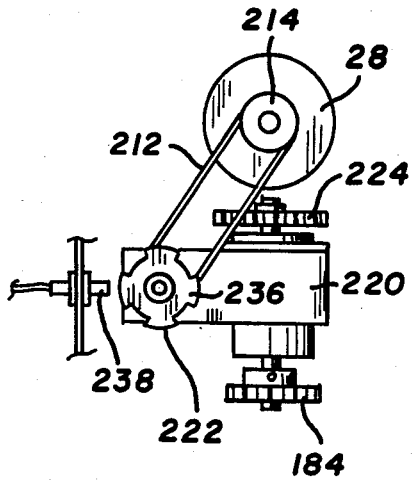
FIG. 8 is an end view of the components shown in FIG. 7, taken along the line 8—8 in FIG. 7.

As seen from FIG. 8, encoder disc 222 rotates with pulley 216, and thus at a speed that varies linearly with the speed of transport motor 28. The encoder disc has four encoder extensions 236, but could have any desired number. Extensions 236 are carried in succession past a transport speed sensor 238 mounted to frame 18. Transport speed sensor 238 is a proximity switch that registers a pulse each time one of encoder extensions 236 passes the switch.

Figure 9:
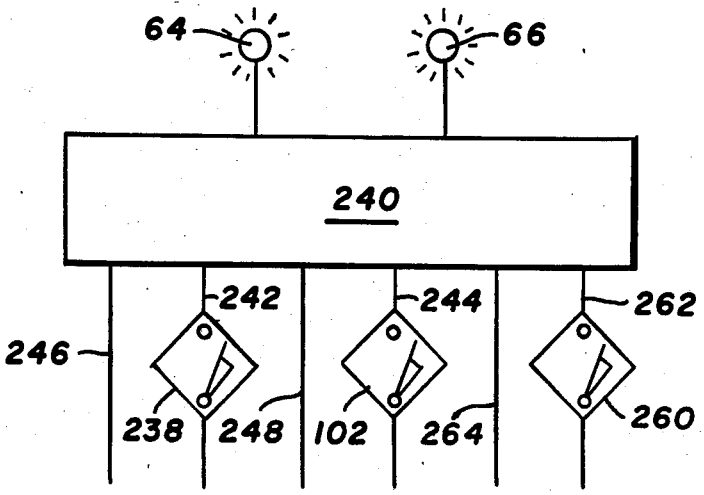
FIG. 9 is a schematic representation illustrating the operation of circuitry in the bag closure device.

A microprocessor 240 is mounted to bag closure device 16, and is shown schematically in FIG. 9. Input connections to microprocessor 240 include a first lead 242 from transport speed sensor 238, and a second lead 244 from thread sensor 102. First and second jumper lines 246 and 248 are associated with leads 242 and 244, respectively. Input lead 242 provides a transport velocity signal comprised of the pulses generated at sensor 238, while lead 244 provides to the microprocessor a thread velocity signal comprised of the pulses generated at transport sensor 102. A portion of the circuitry in microprocessor 240 functions as a comparator to compare the frequencies of the transport velocity signal and the thread velocity signal. An appropriate ratio between these signals, predetermined to correspond to the proper matching of thread speed and transport speed, is thus monitored by the microprocessor.

In the event that the thread speed, as sensed by sensor 102, deviates from its desired correspondence with bag transport speed, the ratio of transport speed signal frequency and thread speed signal frequency deviates from the predetermined value and the first comparator, upon sensing this deviation, generates a warning signal used to light lamp 64. Consequently, an operator is alerted to the possibility that proper stitching is not occurring. Alternatively, the fault indication could be the automatic shut-down of the closure device.

Figure 10:
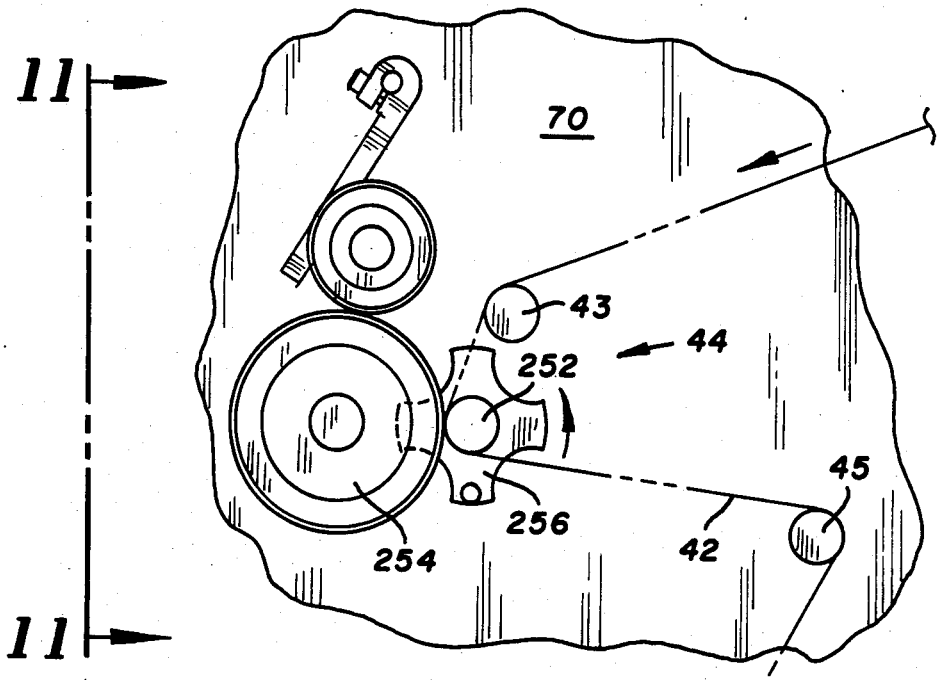
FIG. 10 is an enlarged view of a portion of FIG. 1.

When closure tape is used along with stitching to close bags 20, it is desirable to monitor the speed of closure tape 42 and thread speed, as compared to transport speed. FIG. 10 shows tape speed sensor 44 including a tape sensor roller 252 between idler rollers 43 and 45, which is rotated by the tape as it moves toward tape handling device 36. A friction roller 254 contains tape 42 against the tape sensor roller. The rollers are mounted to support panel 70 integral with frame 18.

Figure 11:
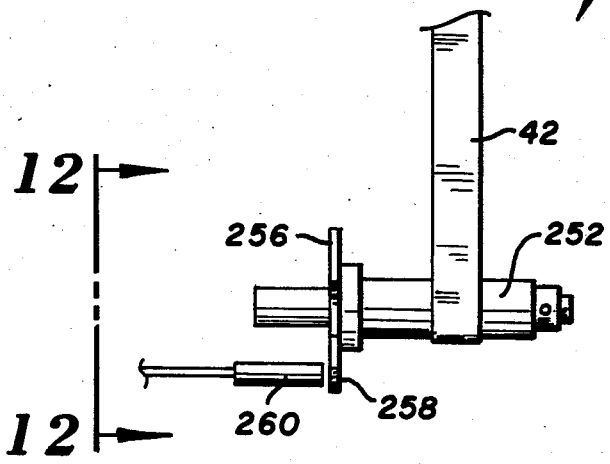
FIG. 11 is an end view taken along the line 11—11 in FIG. 10.
Figure 12:
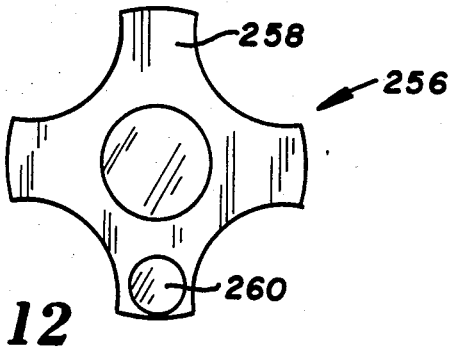
FIG. 12 is an end view taken along the line 12—12 in FIG. 11.

FIGS. 11 and 12 show an indicator 256, fixed to rotate with tape sensor roller 252. Indicator 256 has four indicator extensions 258, spaced apart 90° and passing near the end of a tape sensor 260 fixed with respect to frame 18. Tape sensor 260 is a proximity switch that registers a pulse each time one of indicator extensions 258 passes in front of it. Sensor 260 therefore generates a tape speed signal, the frequency of which is directly proportional to the tape speed.

Returning to FIG. 9, a closure tape lead 262 and associated jumper line 264 are connected to microprocessor 240, and provide the microprocessor with the tape speed signal. Further circuitry in the microprocessor provides a second comparator, for comparing the frequencies of the tape speed signal and transport speed signal. As was true in the case of measuring thread speed, a desired ratio of these frequencies is selected, corresponding to a desired relation between tape speed and bag transport speed. A deviation of closure tape speed, from the desired correspondence to transport speed, causes a deviation in the associated signals from the appropriate ratio, whereupon the second comparator generates a fault signal by illuminating second lamp 66. Hence, the operator is alerted to the deviation in tape speed.

Thus, thread speed and tape speed are continually compared to the transport speed, and a fault is indicated only upon deviation from one of the predetermined ratios. As a result, transport speed can be increased or decreased to suit a particular closure process, with the proper thread speed and tape speeds automatically adjusted. This provides a significant advantage with respect to time dependent monitoring systems, which require adjustment if the transport velocity is altered. The apparatus is simple and can be directly retrofit to existing bag closure machinery, to provide a warning signal or shut-down of the machinery in the event of any deviation in tape or thread velocity.

What is claimed is:

1. An apparatus for closing the open ends of pliant containers including:

a frame; a closing station mounted with respect to said frame; and a container transport means mounted to said frame for moving a plurality of pliant containers in succession past said closing station;

a first supply means mounted to said frame for continuously feeding a first closure material to said closing station, for the joinder of said first closure material with said containers at said open ends, to close said containers as they are moved past said closure station;

a first sensing means mounted with respect to said frame for generating a first signal having a first signal level which varies with the velocity of said container transport means;

a second sensing means mounted with respect to said frame for generating a second signal having a second signal level that varies with the speed at which said first closure material is moved from said supply means toward said closing station; and comparator means, receiving said first and second signals as inputs for comparing said first and second levels and for providing a first fault indication whenever the ratio of said first and second levels deviates from a first predetermined normal range.

2. The apparatus of claim 1 wherein:

said first level varies linearly with the velocity of said container transport means, said second level varies linearly with the supply speed of said first closure material, and said first and second levels are frequencies.

3. The apparatus of claim 1 wherein:

said container transport means comprises two opposed endless carrier chains with parallel, spaced apart lengths running along said closing station; a transport motor; and a drive train for drivably associating said transport motor and said carrier chains.

4. The apparatus of claim 3 wherein:

said first sensing means comprises a first indicator element drivably associated with said motor, and a first sensing element mounted with respect to said frame and proximate said first indicator element, for generating said first signal responsive to movement of said first indicator element.

5. The apparatus of claim 4 wherein:

said second sensing means comprises a second indicator element drivably associated with said first closure material, and a second sensing element mounted with respect to said frame and proximate said second indicator element for generating said second signal responsive to movement of said second indicator element.

6. The apparatus of claim 1 wherein:

said second sensing means comprises a second indicator element drivably associated with said first closure material, and a second sensing element mounted with respect to said frame and proximate said second indicator element for generating said second signal responsive to movement of said second indicator element.

7. The apparatus of claim 1 wherein:

said comparator means includes a microprocessor.

8. The apparatus of claim 1 wherein:

said first closure material comprises a continuous strip of closure tape, and said first supply means is a supply reel for said closure tape.

9. The apparatus of claim 8 further including:

a second supply means for continuously feeding thread to said closing station for forming stitches through the sides of said containers near said open ends, and through said tape, thereby to further secure said closure; and a third sensing means for generating a third signal having a third signal level that varies with the speed at which said thread moves from said second supply means to said closing station;

said comparator means receiving said third signal as a third input, and comparing said first and third levels, and providing a second fault indication whenever the ratio of said first and third levels deviates from a second predetermined normal range.

10. The apparatus of claim 9 wherein:

said third sensing means comprises an idler pulley mounted rotatably with respect to said frame and frictionally engaged with respect to said thread to rotate in response to linear movement of the thread, said third sensing means including a third indicator element integral with said pulley, and a third sensing element mounted with respect to said frame proximate said third indicator element for generating a signal responsive to rotation of said pulley.

11. The apparatus of claim 10 including:

an endless elastic band secured around said pulley, and frictionally engaged with said pulley and with said thread.

12. The apparatus of claim 11 wherein:

said thread is in wrapping engagement with substantially the entire perimeter of said idler pulley.

13. An apparatus for detecting the speed of thread as it is fed from a supply means to a sewing station, including:

a frame, a thread supply means mounted to the frame, and a sewing station mounted to the frame in spaced apart relation to the thread supply means;

an idler pulley mounted rotatably with respect to said frame along the path of said thread, and frictionally engaged with respect to the thread;

a first indicator element carried on said idler pulley, and a sensing means mounted with respect to said frame for registering a pulse each time said first indicator element passes proximate the sensing means, thereby to generate a velocity signal which varies with the rotational velocity of said idler pulley; and a comparator means for comparing the level of said velocity signal with a reference signal level, and a fault indicator means for indicating a sensed deviation of said velocity signal level from a predetermined relation to said reference signal level.

14. The apparatus of claim 13 wherein:

said velocity signal level and said reference signal level are frequencies.

15. The apparatus of claim 13 wherein:

said thread lies against the perimeter of said idler pulley in substantially surrounding relation to the pulley.

16. The apparatus of claim 15 including:

an elastic band surrounding said pulley, frictionally engaged with said pulley, and defining the perimeter of the pulley.

17. The apparatus of claim 13 including:

a container transport means mounted to said frame for moving a plurality of pliant containers in succession past said sewing station.

18. The apparatus of claim 17 wherein:

said reference signal is generated by a second sensing means mounted with respect to said frame, said reference signal level varying linearly with the speed of said container transport means.

19. The apparatus of claim 18 wherein:

said container transport means includes two opposed endless carrier chains with parallel, spaced apart lengths running past said closing station; a transport motor; and a drive train for drivably associating said motor and chains.

20. The apparatus of claim 19 wherein:

said second sensing means includes a second indicator element drivably engaged with said motor, and a second sensing element integral with said frame and proximate said second indicator element, for generating said reference signal in response to movement of said second indicator element.

21. A process for effecting a closure of the open ends of pliant containers, and for detecting a deviation from a desired amount of closure material employed in said closure, including the steps of:

transporting a pliant container past a stitching station using a container transport means;

generating a first signal, the level of which is directly related to the transport speed of said containers;

supplying thread to said stitching station;

generating a second signal, the frequency of which is directly related to the speed at which thread is supplied to said stitching station;

comparing the levels of said first and second signals; and generating a thread fault indication responsive to a sensed deviation in the ratio of said first and second levels from a predetermined ratio.

22. The process of claim 21 wherein:

said step of generating a second signal includes positioning an idler pulley in frictional engagement with said thread, providing a first indicating element near the perimeter of said idler pulley, and registering the number of times said first indicating element passes a fixed location proximate said idler pulley to generate said second signal.

23. The process of claim 21 wherein:

said step of transporting compliant containers includes frictionally engaging portions of said containers with moving endless carrier chains, and wherein said step of generating a first signal includes sensing the velocity of said carrier chains.

24. The process of claim 21 including the further steps of:

feeding a closure tape to a selected location along the path of travel of said containers upstream from said sewing station and joining said closure tape with the open ends of said containers to effect a tape closure of said containers;

generating a third signal, the level of which is directly related to the speed at which said closure tape is supplied to said selected location;

comparing the levels of said first and third signals; and generating a tape fault signal responsive to a sensed deviation in the ratio of said first and third levels from a predetermined ratio.

* * * * *